United States Patent [19]

Ohwada et al.

[11] Patent Number: 4,746,038

[45] Date of Patent: May 24, 1988

[54] GAS-BLOW CASTING NOZZLE

[75] Inventors: Yasunori Ohwada; Shiro Sukenari, both of Ohita; Haruyoshi Kimura; Hiroyuki Shiokawa, both of Kitakyushu, all of Japan

[73] Assignees: Nippon Steel Corporation, Tokyo; Kurasaki Refractories Co., Ltd., Fukuoka, both of Japan

[21] Appl. No.: 882,662

[22] Filed: Jul. 7, 1986

[30] Foreign Application Priority Data

Jul. 10, 1985 [JP] Japan ..... 60-105888[U]

[51] Int. Cl.[4] ..... B22D 11/10

[52] U.S. Cl. ..... 222/603; 164/337; 164/437; 266/220

[58] Field of Search ..... 222/603, 591; 164/337, 164/415, 437, 475; 266/220

[56] References Cited

U.S. PATENT DOCUMENTS 3,253,307 5/1966 Griffiths et al. ..... 222/603 X
4,531,567 7/1985 Gruner et al. ..... 222/603 X

FOREIGN PATENT DOCUMENTS 1094517 12/1954 France ..... 222/591
56-102357 8/1981 Japan .
834234 5/1960 United Kingdom ..... 222/603
263833 7/1970 U.S.S.R. ..... 222/591

*Primary Examiner*—Joseph J. Rolla
*Assistant Examiner*—Frederick R. Handren
*Attorney, Agent, or Firm*—Jordan and Hamburg

[57] ABSTRACT

A gas-blow casting nozzle has an annular gas-blowing hollow chamber with a gas-permeable part which is provided between the hollow chamber and the pouring hole of the nozzle body, and a number of joint parts for integrally joining the inner wall and the outer wall of the hollow chamber, which are provided in the radial direction of the annular hollow chamber. The total of the vertical section of the cylindrical area of the joint parts is about 30% to 70% of the cylindrical area of the hollow chamber. The gas-blowing hollow chamber which has the function of a heat-insulating layer is so constructed that the inner wall and the outer wall of the hollow chamber are partially and uniformly joined with the joint parts, and the joint parts are made to have the function of a heat-transfering layer, whereby the temperature difference in the radial direction of the nozzle body may be made small and the occurrence of thermal stress in the casting nozzle may be prevented. Because of the reduction of the temperature difference between the inner part and the outer part of the hollow chamber in the gas-blow casting nozzle, the breakdown damage of the nozzle body may be prevented.

9 Claims, 6 Drawing Sheets

GAS-BLOW CASTING NOZZLE

FIELD OF THE INVENTION

The present invention relates to the improvement of submerged nozzles and shroud nozzles for casting equipment, having a gas-blow structure.

BACKGROUND OF THE INVENTION

In recent years, submerged and shroud nozzles have been widely used in the field of continuous casting of molten metals, in which an inert gas is blown into a molten metal, for the purpose of improving the quality of the cast products such as steel or of preventing the nozzles from being clogged up with materials adhered thereto.

An example of a submerged nozzle is described in the specification of Japanese Patent Application Laid-open No. 56-102357, which has a gas-blowing hollow chamber with an annular section in the axial direction of the nozzle body. A gas is blown from the hollow chamber into the molten metal flowing in the pouring hole of the submerged nozzle.

The gas-blowing hollow chamber is provided with bridges of a small diameter in the inner part thereof, whereby the breakdown of the hollow chamber due to the pressure of the molten metal can be prevented.

This hollow chamber is empty and therefore has the function of a heat-insulator between the axial part and the peripheral wall part, and causes remarkable temperature difference between the inner refractory part and the outer refractory part of the hollow chamber by its insulating effect, which results in yielding a thermal stress therebetween. Consequently, the refractory part in the outer wall of the hollow chamber is in danger of breakdown in spite of the provision of the reinforcing bridges therein.

SUMMARY OF THE INVENTION

The object of the present invention is to reduce the temperature difference between the inner part and the outer part of the hollow chamber in a gas-blow casting nozzle, thereby to prevent the breakdown of the nozzle body due to thermal stress caused by the temperature difference.

In order to attain the object, the present invention provides a novel gas-blow casting nozzle composed of a cylindrical gas-blowing hollow chamber having a a gas-permeable part, which is provided between the hollow chamber and the pouring hole of the nozzle body, and a number of joint parts for integrally joining the inner wall and the outer wall of the hollow chamber, which are partially provided in the radial direction of the cylindrical hollow chamber, characterized in that the total cylindrical section area of the joint parts is about 30% to 70% of the cylindrical area of the hollow chamber.

According to the present gas-blow casting nozzle, the gas-blowing hollow chamber which has a function as a heat-insulating layer is so constituted that the inner wall and the outer wall of the hollow chamber are partially joined with joint parts to function as a heat-transfering layer, whereby the temperature difference in the radial direction of the nozzle body can be made to decrease and thus the occurrence of thermal stress in the casting nozzle can be prevented.

DESCRIPTION OF THE PREFERRED EMBODIMENTS

Figure 1:
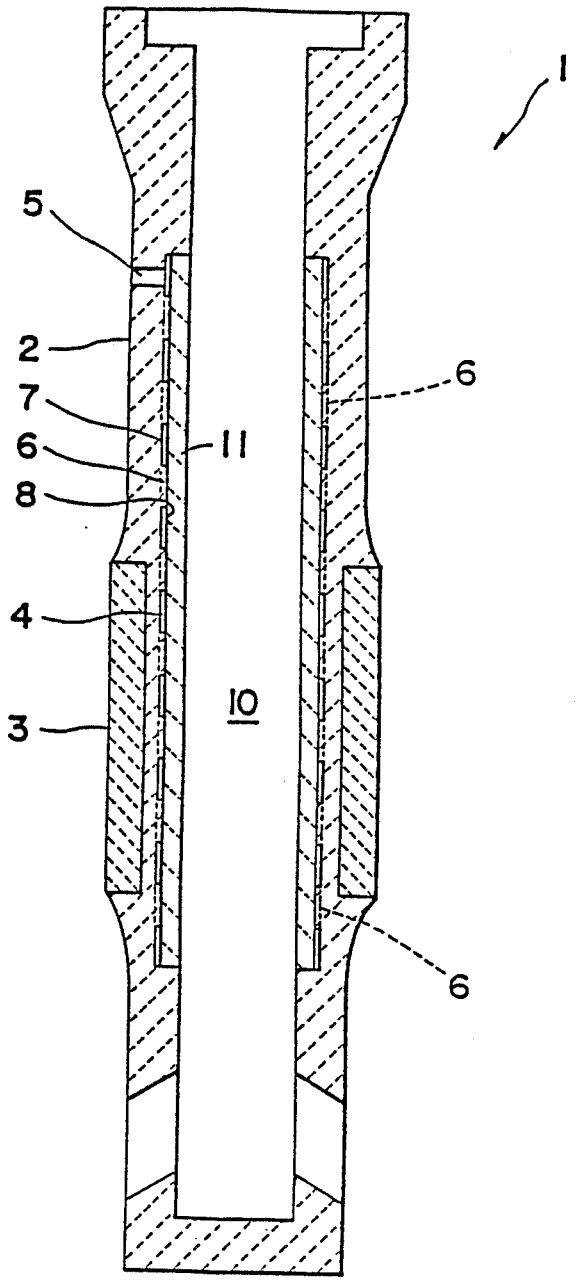
FIG. 1 is a front section view of a submerged nozzle in accordance with the present invention.

The construction and operation of the present invention will be explained in more detail with reference to some preferred embodiments shown in the accompanying drawings.

In the drawings, (1) is a submerged nozzle, (6) is a joint, (2) is a nozzle body, (7) is an outer wall part, (3) is a protective jacket for a slag line, (8) is an inner wall part, and (4) is a hollow chamber.

The submerged nozzle (1), as shown in FIG. 1, is constructed to form a pouring hole (10) extending in the axial direction thereof. The cylindrical nozzle body (2) is made of a refractory material and is provided with a protective jacket (3) for a slag line in the center part thereof and with a gas-permeable part (11) which faces the pouring hole (10).

(4) is an annular hollow chamber provided around the peripheral wall of the gas-permeable body (11) at the inner part of the nozzle body (2), and has a socket (5) which is connected with a gas-feeding duct (not shown), in the upper portion thereof.

(6) is a joint part to integrally join the outer wall part (7) at the side of the nozzle body (2) with the inner wall part (8) at the side of the gas-permeable part (11), and is placed to extend across the hollow space of the chamber (4) in the radial direction thereof. This joint part (6) has the function of a heat-transfer zone to transfer the heat from the gas-permeable part (11) in the direction of the outer nozzle body (2), and this joint part (6) is preferably made of the same refractory material as the nozzle body (2).

In such construction the heat as kept in the inner wall part (8) is transferred to the outer wall part (7) by the heat-transfer of the joint part (6), when molten metal flows through the pouring hole (10).

Thus, a part of the hollow chamber (4) having the function of a heat-insulating layer is filled with the joint parts (6) made of a refractory material, in such a way that the joint parts (6) do not interfere with the path of the gas flow, so that the heat in the chamber (4) may properly be transferred through the joint parts (6) and the thermal stress of the nozzle body may be reduced.

Regarding the arrangement of the joint parts (6), these are preferably distributed uniformly in the vertical direction and in the horizontal direction, in order to attain uniformity of the gas to be passed to the pouring hole (10) and the uniformity of the thermal stress distribution occurring in the nozzle body (2).

Figure 2:
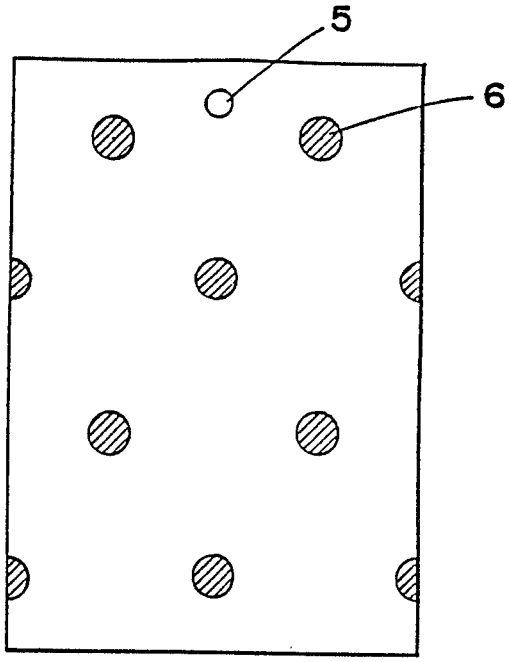
FIG. 2 is a development section view of a hollow chamber in which the total area of the joint parts is 5%.
Figure 3:
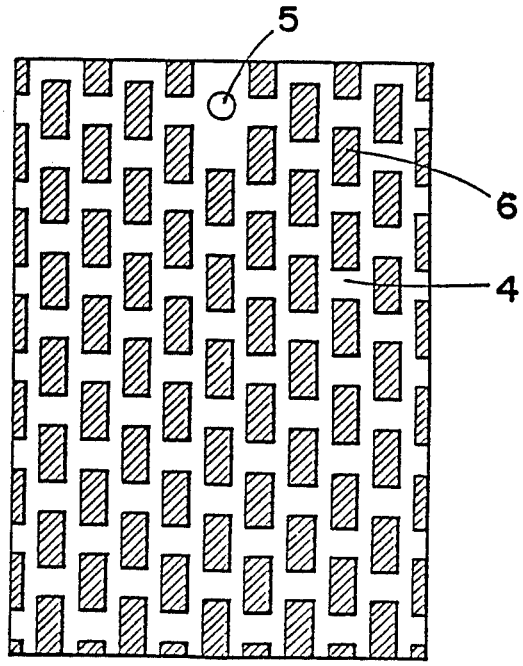
FIG. 3 is a development section view of a hollow chamber in which the total area of the joint parts is 50%.

FIG. 2 and FIG. 3 are partial development views each to showing the arrangement and the distribution of the hollow chamber (4) and the joint parts (6) each having the function of a heat-transfer part made of a refractory material, in which the total cylindrical area of the joint parts (6) is 5% (FIG. 2) and 50% (FIG. 3) of the cylindrical area of the hollow chamber (4).

The construction comprising such area ratio was utilized with the nozzle body (2), and a flame burning LPG with oxygen was passed into the pouring hole (10) to heat the hole (10) of the submerged nozzle (1), and the degree of the breakdown damage of the nozzle was compared.

As a result thereof, the degree of the breakdown damage of the nozzle body (2) in the case of FIG. 2 where the total area of the joint parts (6) was 5% was 100%, while that in the case of the FIG. 3 where the total area of the joint parts (6) was 50% was zero.

This result proves that the safety against breakdown is extremely high in the nozzle body (2) having such construction where the area of the joint parts (6) is 50%.

Figure 4:
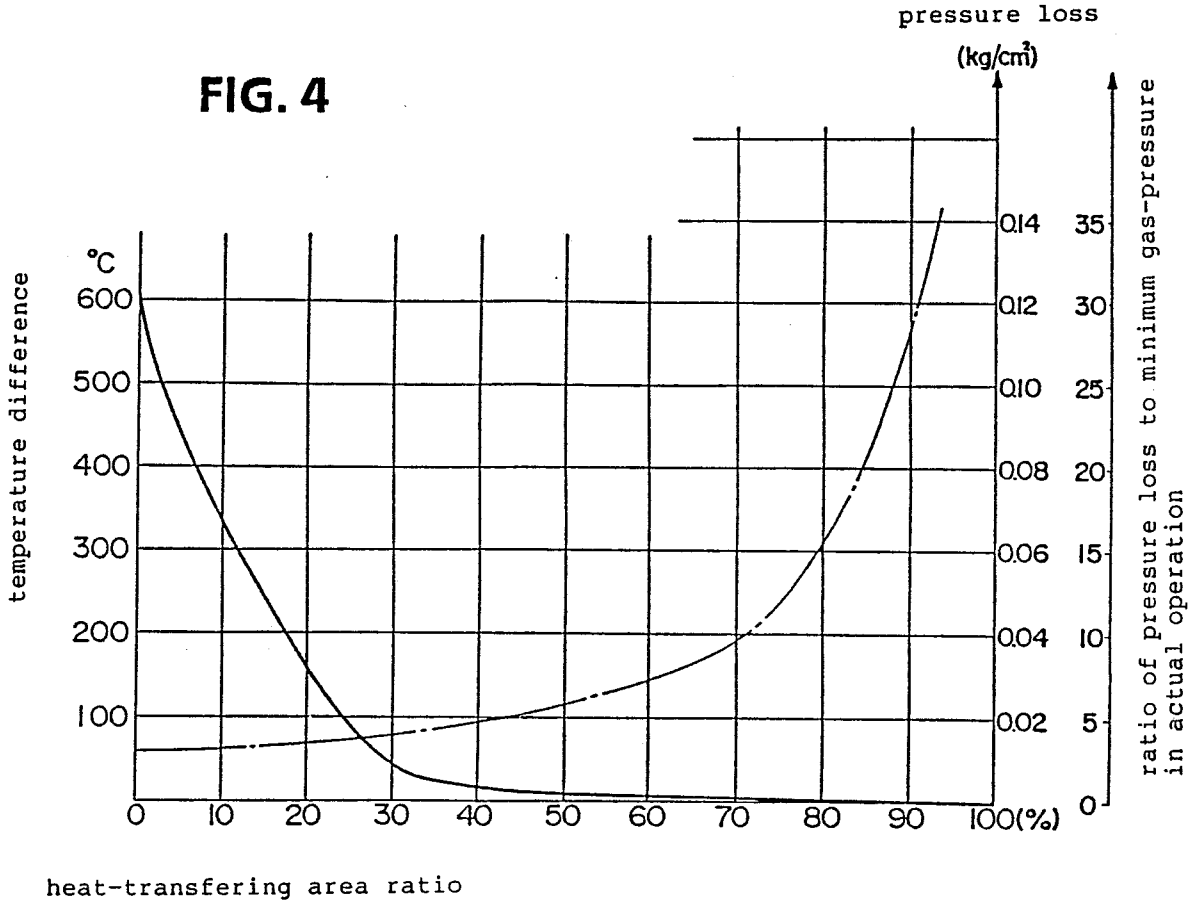
FIG. 4 is a graph to show the gas pressure loss as calculated from the heat-transfer characteristic and the theoretical calculation on the basis of experimental data as obtained by the provision of the joint parts in the hollow chamber.
Figure 5:
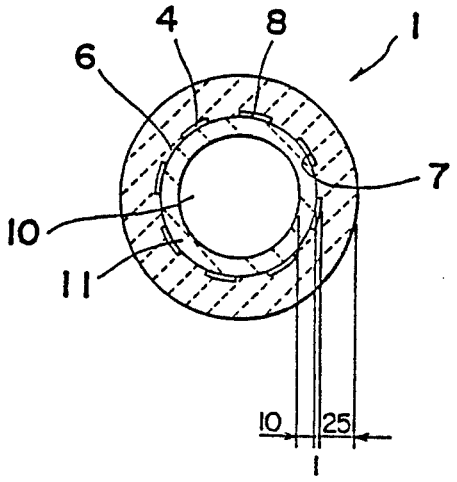
FIG. 5 is a section view of the nozzle structure as used in the experimental measurement of FIG. 4.

FIG. 4 is a graph showing the characteristic curves between the heat-transfer effect and the pressure loss. The solid line shows the result as obtained from an experiment where the sectional structure of the nozzle body (2) is composed of the pre-shaped gas-permeable part (11), the hollow chamber (4) and the nozzle body (2) each having a thickness of 10 mm, 1 mm and 25 mm, respectively, as shown in FIG. 5, and the physical characteristics of the gas-permeable part (11) and the nozzle body (2) are as follows:

| Physical characteristics | Nozzle body | Gas-permeable part |
|---|---|---|
| Heat-transfer coefficient (kcal/m · hr °C.) | 13 | 12 |
| Specific heat (kcal/kg °C.) | 0.27 | 0.25 |
| Thermal expansion coefficient ($\times 10^{-5}$/°C.) | 0.28 | 0.22 |
| Specific gravity | 2.36 | 2.28 |
| Modulus of elasticity ($\times 10^4$ kg/cm$^2$) | 8.8 | 8.0 |
| Poisson's ratio | 0.25 | 0.25 |
| Chemical composition: | | |
| $Al_2O_3$ | 49 | 47 |
| FC | 25 | 21 |
| $SiO_2$ | 10 | 24 |

In this Figure, the heat-transfer characteristic as shown by the solid line is represented by the vertical axis to show the temperature difference between the temperature of the inner wall part (8) and that of the outer wall part (7) of the hollow chamber (4) and the horizontal axis to show the production of the total area of the refractory joint parts (6) to the area of the total wall of the hollow chamber (4) in the development plane of the hollow chamber (4). In accordance with this characteristic curve, it has been confirmed that the temperature difference becomes extremely large when the heat-transfering area of the joint parts (6) is less than 30% of the total development area of the hollow chamber (4).

Further, it is noted that the temperature difference is about 50° C. or less when the heat-transfering area of the joint parts (6) is 30% or more of the area of the hollow chamber (4) and that the temperature gradient becomes far smaller in the range of 40% and the temperature difference reaches almost zero in the case of 100%. Accordingly, it has been confirmed that the range of 30 to 40% corresponds to the critical point of the heat-transfer effect.

The dotted line in the same FIG. 4 shows the relation between the heat-transfering area ratio and the proportion of the pressure loss to the gas pressure in actual use (in case of 5Nl/min), as calculated from the following formulae, in one typical submerged nozzle with a hollow chamber where the inner diameter of the hollow chamber (4) is 90 mm, the length thereof is 415 mm and the thickness of the gas-permeable part (11) is 10 mm, the refractory hole therein as a path for the gas flow being assumed to be a vertical cylinder.

$$\Delta P = 32 \cdot \mu \cdot V \cdot l / d^2 \quad (1)$$

$$V = Q / K \cdot S \cdot n \cdot A \quad (2)$$

in which:

ΔP: pressure loss
μ: coefficient of gas viscosity
V: gas flow speed
d: diameter of the hole for gas flow
l: length of the hole for gas flow
Q: total amount of gas flow to be blown
K: (1-heat-transfering area ratio)
S: inner wall area of hollow chamber
n: number of gas flow holes per unit area
A: sectional area of one gas flow hole From the above formulae (1) and (2), the following data are obtained by calculation in case of l = 10 mm:

| Heat-transfering area ratio (%) | Pressure loss (Δ Pkg/cm$^2$) |
|---|---|
| 0 | 0.0116 |
| 30 | 0.0166 |
| 50 | 0.0232 |
| 70 | 0.0387 |
| 90 | 0.1160 |

These numerical data are plotted to give the dotted line in FIG. 4, which shows the theoretical characteristic curve for the relation between the heat-transfering area ratio and the pressure loss.

This characteristic curve shows that, when the heat-transfering area ratio in the joint part (6) exceeds 70%, the pressure loss of the gas flow in the gas-permeable part (11) rapidly increases. The increment of the gas pressure loss results in the necessity of the increasing of the pressure of the blowing gas, which, however, will result in the danger of gas-leakage from the joint parts in the gas flow line duct or, as the case may be, will result in a danger of unevenness of the gas-blowing from the whole inner surface of the gas-permeable part (11) because of the joint parts (6).

In view of the results of the above experiment and calculation, the upper limitation of the heat-transfering area ratio or the ratio of the cylindrical section area of the joint parts (6) to the whole cylindrical area of the hollow chamber (4) is determined to be 70% in the present invention, in order to eliminate the problem of the pressure loss, in comparison with the conventional structure of the related arts.

In addition, the characteristic curve on the pressure loss may further be represented by the ratio on the basis of the minimum value of the gas-blowing pressure in the actual use of the nozzle, which is given in the same FIG.

4. For this, the proportion of the pressure loss (unit: %) to the minimum gas-pressure value in the actual operation is given in the vertical axis of the graph. It is apparent that the characteristic curve may be applied to any other cases using nozzles of different shapes or different materials or using different gas-blowing conditions than the case of the nozzle constitution as used in the above calculation, by the use of the proportion to the minimum value of the gas-blowing pressure in the characteristic curve.

Figure 6:
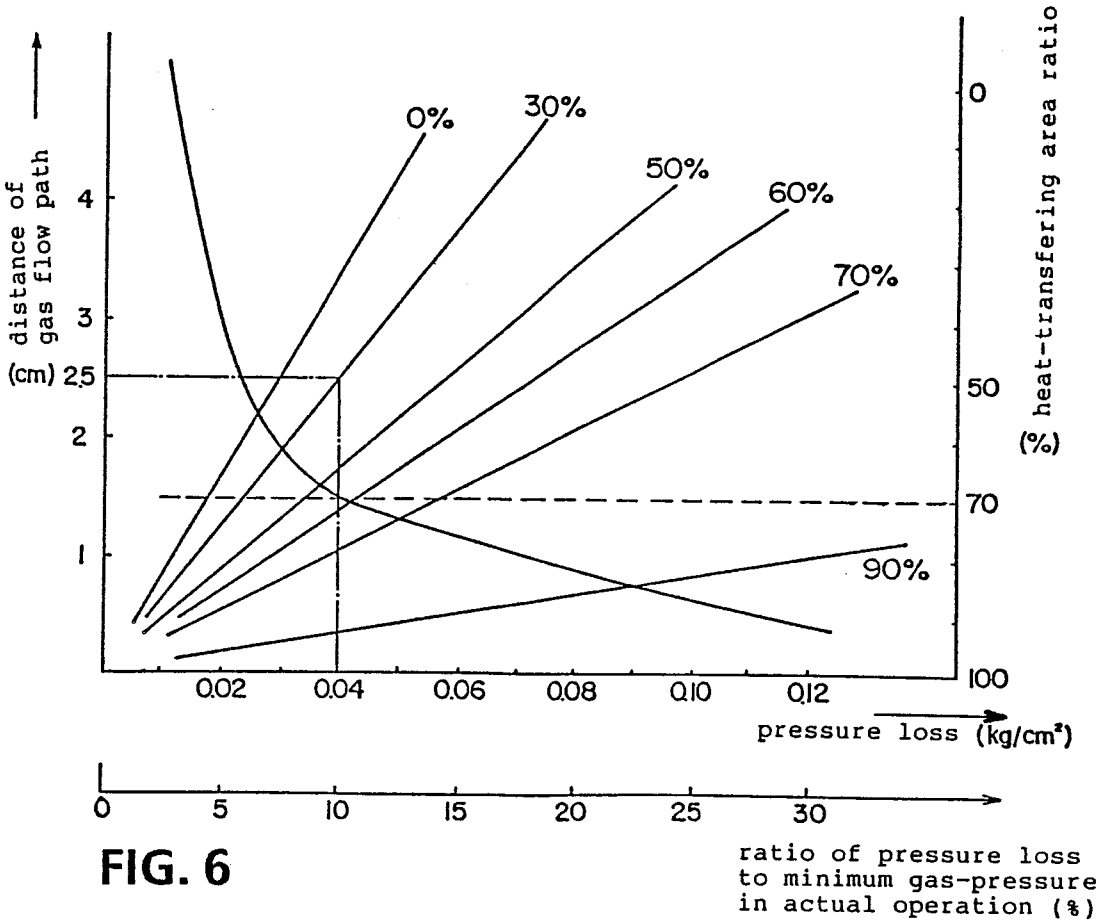
FIG. 6 is a graph showing the relation between the heat-transfering area of the joint parts, the length of the gas flowing line and the pressure loss of the gas flow.

FIG. 6 shows the limitation relating to the shape of the joint parts (6) for the purpose of attaining uniform gas-blowing from the whole inner surface of the gas-permeable part (11); and this further shows the relation between the pressure loss of the gas flow which passes through the gas-permeable part (11) and the length of the gas flow path with the variation of the heat-transfering area ratio of the joint parts (6) as well as the relation between the heat-transfering area ratio and the pressure loss.

More precisely, in the graph of FIG. 6, the curve shows the relation between the heat-transfering area of the joint parts (6) and the gas-pressure loss of the gas flow, and the straight lines show the relation between the distance of the gas flow path and the gas pressure loss with the variation of the heat-transfering area within the range of 0 to 90%, and in addition, the dotted line shows the critical uppermost value of 70% of the heat-transfering area as obtained from the aforementioned results.

In addition, in the graph of FIG. 6, the characteristic curve for the pressure loss may be further represented by the ratio on the basis of the minimum value of the gas-blowing pressure in the actual use of the nozzle, analogously to the graph of the aforementioned FIG. 4. For this, the proportion of the pressure loss (unit: %) to the minimum gas-pressure value in the actual operation is given in the horizontal axis of the graph.

Figure 7:
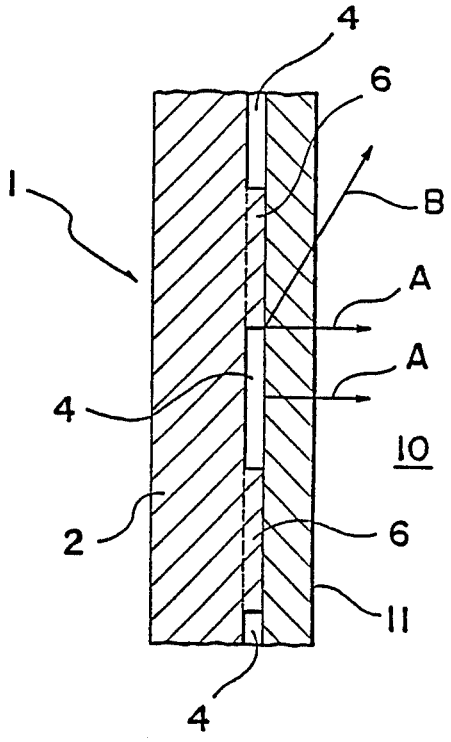
FIG. 7 is an explanatory illustration to show the gas flow in the parts near the joints.

The gas flow near the joint parts (6) is assumed as shown in FIG. 7, and the gas flow path (B) in the center region of the joint part (6) (between the hollow chambers as partitioned) is made longer than the gas flow path (A) in the region without the joint part (6) and therefore the gas-pressure loss in the former is longer than the latter.

Accordingly, in order to attain uniform gas-blowing from the whole inner wall of the gas-permeable part (11), it is noted that the elevation of the heat-transfering area ratio by the provision of the joint parts (6) and the reduction of the difference between the length of the gas flow pass (A) and that of the gas flow path (B) are necessary, whereby the difference of the gas flow difference between the paths (A) and (B) may be made smaller and thus uniform gas-blowing from the whole inner wall of the gas-permeable path (11) may become possible.

In case the heat-transfering area of the joint parts (6) is 30%, the difference of the gas-pressure loss in the paths (A) and (B) becomes larger when the ratio of the length of these paths become 2.5 or more, and therefore, it becomes necessary to make the minimum gas pressure in actual use higher than conventional gas pressure by more than 1.1 times in order to attain uniform gas-blowing from the wall of the gas-permeable part (11), which results in the requirement for increasing the amount of gas flow to be blown thereinto.

Because of these reasons, therefore, increasing the gas flow causes problems in the actual operation and it is desired to reduce the amount of the gas flow to the possible minimum in general practice.

Therefore, a preferable limitation relating to the shape of the joint part (6) for the purpose of attaining uniform gas-blowing from the whole inner wall of the gas-permeable part (11) is that the shortest distance from any point of the joint part (6) to the periphery of the part (6) is 2.5 times or less of the thickness of the gas-permeable part (11).

The relation between the gas-pressure loss of the gas flow passing through the gas-permeable part (11) and the length of the gas flow path with the variation of the heat-transfering area ratio of the joint parts (6) in the FIG. 6 was obtained from the relation of l and $\Delta P$ in the aforementioned formulae (1) and (2) with the variation of K therein, these formulae being used for the calculation of the heat-transfering area ratio and the gas-pressure loss.

The present invention will be explained in more detail by reference to the following examples, which, however, are not intended to be interpreted as limiting the scope of the present invention.

EXAMPLE 1

For the manufacture of an alumina/graphite submerged nozzle for continuous casting, in which the inner wall area of the hollow chamber is 1100 $cm^2$, the thickness of the gas-permeable part (11) is 10 mm and the heat-transfering area of the joint parts (6) is 70% of the whole wall area of the hollow chamber (4), a wax layer having a determined thickness enough to form the hollow chamber (4) was coated on the peripheral surface of a pre-shaped gas-permeable part (11), and then, rectangular holes each having a length of 55 mm in the vertical direction of the nozzle axis and a length of 3 mm in the cross direction thereof were provided in the wax layer in an amount of 78 hole uniformly in the peripheral direction and 6 holes uniformly in the axial direction, totaling 468 holes in all.

The gas-permeable part (11) was set in a determined position in a mandrel for the formation of an pouring hole for molten steel, and then, a rubber die for the molding of the main body was set thereto.

The necessary materials for the formation of the main body were filled in the rubber die and, after the die was sealed with a lid, the materials were molded under compression with a pressure of 1000 $kg/cm^2$ by rubber-press.

Afterwards, the nozzle thus molded was embedded in a coke powder and fired by reduction, to obtain an alumina/graphite submerged nozzle of the present invention, having a heat-transfering area of 70%.

This nozzle was dipped in water, and air was blown thereinto under a pressure of 0.4 $kg/cm^2$, whereupon the gas flow from the inner wall of the gas-permeable body (11) was observed and uniform generation of air bubbles from the holes of the part (11) was confirmed.

Next, The present nozzle was used in the actual casting of molten steel having a gross weight of 2040 tons in a furnace, whereupon neither breakdown damage of the nozzle nor clogging thereof occurred during the operation and the nozzle was used with safety.

The material for the formation of the hollow chamber, the binder and the aggregate as used in the manufacture of the present nozzle were as follows;

(1) Material for the formation of the hollow chamber:

A cylindrical or plate-like articles made of an organic fiber such as a cardboard, cloth or Japanese paper, as well as a cylindrical or plate-like article made of an organic substance such as wax, rubber, acrylic resin, polyethylene, vinyl chloride or styrol may be used. Further, the said organic fiber or organic substance may be coated on the pre-shaped gas-permeable part (11).

(2) Binder:

A conventional binder for general refractory materials, such as dextrins, lignin sulphate, molasseses or magnesium chloride, as well as a binder which may remain in the refractory in the form of carbon under heat in the firing or in the actual use of the nozzle, such as phenol resins, may be used.

(3) Aggregate:

Metal oxides, carbides or nitrides which are generally used in conventional refractories, such as $Al_2O_3$, $SiO_2$, MgO, $ZrO_2$, $MgO.Al_2O_3$, SiC or metal silicone, as well as combinations of metals and graphites of one or more kinds may be used.

EXAMPLE 2

For the manufacture of an alumina/graphite submerged nozzle for continuous casting, which is provided with a hollow chamber, a paraffin wax was coated on a pre-shaped gas-permeable part (11) to form a layer having a determined thickness, and then, 197 independent holes each having a diameter of 20 mm were formed in the layer, which correspond to 50% of the whole surface area (1239 $cm^2$) of the paraffin wax coat layer.

Next, the gas-permeable part (11) was set to the mold for the formation of the molten metal-pouring hole of a submerged nozzle, and then, the material for the formation of the nozzle body (2) was put in the space between the rubber die for the formation of the nozzle body (2) and the said mold. After being sealed with a lid, the material was molded under compression with a rubber-press and thereafter fired.

The nozzle thus manufactured was used in the actual casting of molten steel having a gross weight of 1750 tons in a furnace, whereupon neither breakdown damage of the nozzle nor clogging thereof occurred during the operation and the nozzle was used with safety.

EXAMPLE 3

A material prepared by pulverizing a raw material of green clay of alumina/graphite marterial with a certain grain size, blending the resulting powder in a certain proportion and kneading the resulting mixture together with phenol resin, and a shaped article for the hollow chamber (4) comprising a cylindrical cardboard having a peripheral surface area of 346 $cm^2$ and a certain thickness, which had 15 holes each having a diameter of 30 mm as perforated, the gross area of the holes corresponding to 35% of the whole peripheral surface area, were set in a determined position of a mold, and then shaped under pressure by a rubber-press. Next, the shaped article was dried and fired, to obtain the submerged nozzle of the present invention. This nozzle was used in the actual casting of molten steel having a gross weight of 1020 tons in a furnace, whereupon neither breakdown damage of the nozzle nor clogging thereof occurred during the operation and the nozzle was used with safety.

As apparent from the above description, the gas-blow casting nozzle of the present invention is characterized by the following effects, which result from the characteristic construction of the nozzle structure.

(1) The hollow chamber is provided with joint parts which have the function of a heat-transfer zone and the heat-transfer between the outer wall part and the inner wall part which sandwich the hollow chamber can effectively be attained, and therefore, breakdown damage of submerged nozzle because of the temperature difference can be surely prevented.

(2) The joint parts are so provided that the gas-pressure loss may not increase, and therefore, it is unnecessary to elevate the gas-feeding pressure.

What is claimed is:

1. A gas-blow casting nozzle comprising a nozzle body having a pouring passage, a gas-permeable sleeve disposed in said nozzle body, said gas-permeable sleeve having an outer cylindrical wall and said nozzle body having an inner cylindrical wall portion with said outer cylindrical wall and said inner cylindrical wall portion being radially spaced from one another to define a hollow chamber therebetween, and a plurality of joint parts in said hollow chamber, the joint parts being axially and circumferentially spaced from each other and extending between said inner cylindrical wall portion of said nozzle body and said outer cylindrical wall of said gas-permeable sleeve, the total of the area of said spaced joint parts being about 30 to 70% of the total area of said hollow chamber, the shortest distance from any point in any joint part to the periphery of the joint part being 2.5 times or less than the radial thickness of said gas-permeable sleeve.

2. A gas-blow casting nozzle according to claim 1, wherein said nozzle body has a longitudinal axis, said joint parts being evenly spaced in a longitudinal direction and evenly spaced in a circumferential direction.

3. A gas-blow casting nozzle according to claim 1, wherein said joint parts are made of the same material as said nozzle body.

4. A gas-blow casting nozzle according to claim 1, wherein said nozzle body has a passage leading to said hollow chamber for feeding gas to said hollow chamber.

5. A gas-blow casting nozzle according to claim 1, wherein said gas-permeable sleeve has a cylindrical configuration.

6. A gas-blow casting nozzle according to claim 5, wherein said pouring passage has a generally cylindrical configuration, said cylindrically configured gas-permeable sleeve having an inner cylindrical wall generally aligned with said cylindrically configured pouring passage.

7. A gas-blow casting nozzle according to claim 1, wherein said hollow chamber has a generally annular configuration having an axial length substantially equal to the axial length of said gas-permeable sleeve.

8. A gas-blow casting nozzle according to claim 1, wherein said spaced joint parts have a generally rectangular cross-sectional configuration.

9. A gas-blow casting nozzle according to claim 1, wherein said spaced joint parts have a generally cylindrical configuration.

* * * * *